United States Patent [19]

Fröhler et al.

[11] 4,134,805

[45] Jan. 16, 1979

[54] PROCESS FOR ELECTROLYSIS

[75] Inventors: Hanns Fröhler, Munich; Erwin Rossberger, Berg, both of Germany

[73] Assignee: Dipl.-ing. Hanns Frohler KG, Pullach, Germany

[21] Appl. No.: 830,967

[22] Filed: Sep. 6, 1977

[30] Foreign Application Priority Data

Oct. 6, 1976 [DE] Fed. Rep. of Germany ..... 2645121

[51] Int. Cl.[2] ..... C25B 1/25; C25B 1/00; C25B 1/24; C25B 9/00

[52] U.S. Cl. ..... 204/82; 204/90; 204/95; 204/269; 204/275

[58] Field of Search ..... 204/269, 275, 276, 278, 204/86, 82, 90, 93, 95

[56] References Cited

U.S. PATENT DOCUMENTS

| | | | |
|---|---|---|---|
| 3,766,045 | 10/1973 | Itakura et al. | 204/275 |
| 3,936,364 | 2/1976 | Middle | 204/269 |
| 3,983,026 | 9/1976 | Cabaraux et al. | 204/275 |
| 4,060,475 | 11/1977 | Foumier et al. | 204/270 |

*Primary Examiner*—Howard S. Williams

*Attorney, Agent, or Firm*—Sprung, Felfe, Horn, Lynch & Kramer

[57] ABSTRACT

An electrolysis cell having a housing with an inlet and an outlet for a through-flowing electrolyte and at least three monopolar electrodes, each comprising plates fastened on a common carrier in parallel array. The plates of one polarity extend into the gaps formed between the plates of the other polarity and at least one electrode to on polarity is disposed between two electrodes of the other polarity.

18 Claims, 9 Drawing Figures

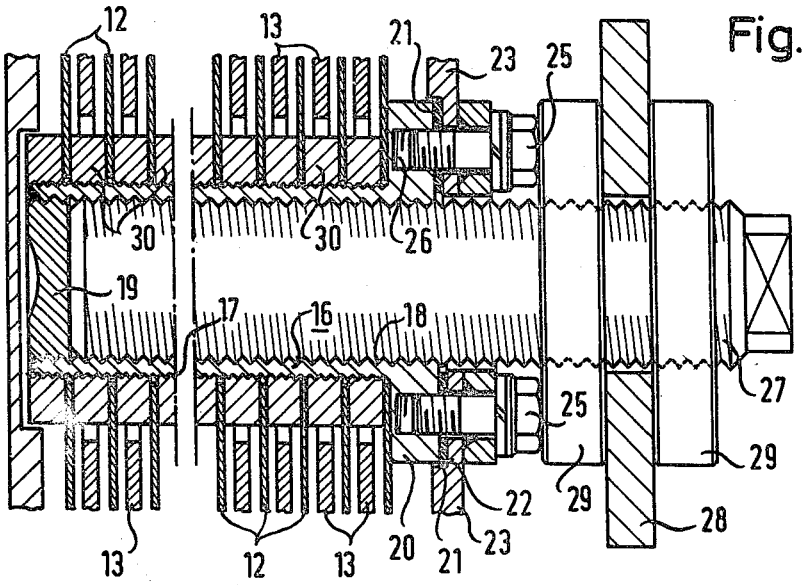
Fig.5
Fig.6
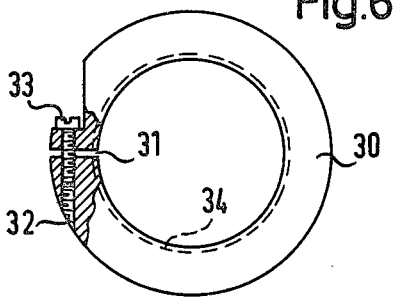
Fig.7
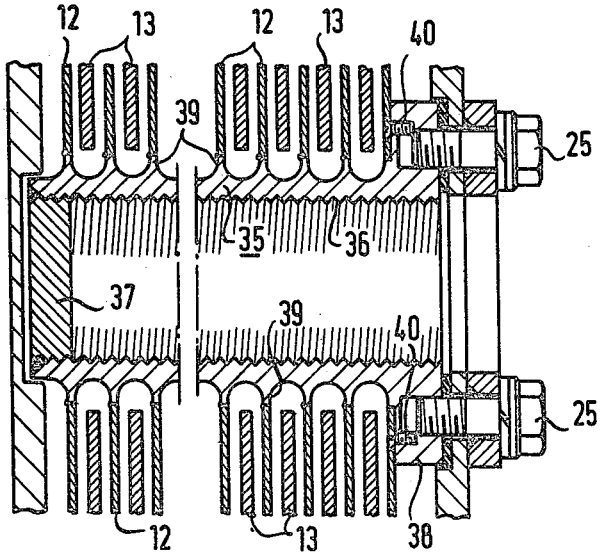

PROCESS FOR ELECTROLYSIS

BACKGROUND OF THE INVENTION

The invention relates to an electrolysis cell having a housing provided with an inlet and an outlet for a throughflowing electrolyte, in which monopolar electrodes are disposed, each of them consisting of plates arranged parallel and fastened to a common support, the electrodes being offset from one another such that the plates of the one polarity extend into the interstices formed between the plates of the other polarity, and it relates also to the use thereof.

Electrolysis cells both of monopolar and of bipolar types of construction are used for the performance of chemical processes. The bipolar cell, which is constructed by placing bipolar electrodes in series in the manner of known filter presses, has the advantage that the leads carrying power to the outer electrodes can be made thinner than they can in a monopolar cell of the same power input, that an electrolysis installation constructed by the arrangement in series of a plurality of bipolar cells requires less space than the monopolar cell installation, and the construction of such an installation is simpler due to the elimination of the often complicated and expensive cell connectors. However, the bipolar cell also has a number of disadvantages with respect to a monopolar cell.

Furthermore, electrolysis cells of rectangular, square and circular cross section are known, in which the flow of the electrolyte can take place in any desired manner through appropriate pipe connection flanges, namely horizontally, meander-wise, diagonally or vertically. In general the vertical direction of flow of the electrolyte is to be preferred for hydrodynamic reasons, especially when short times of stay in the cell are necessary, or when use is to be made of the lifting effect of electrolytically produced gases on the basis of the principle of the air lift pump.

German Auslegeschrift 2,109,949 discloses an electrolysis system having cells arranged in series through which the electrolyte flows vertically, and in which laminated bipolar electrodes are disposed. The bipolar electrodes consist in this case of multi-layer laminated plates on both sides of which there are fastened a plurality of vertically projecting, flag-like or bridge-like electrode plates, those of the one polarity being on the one side and only those of the opposite polarity being on the other. The flag-like portions of the electrodes of the one polarity extend into the interstices formed by the flag-like portions of the electrode of the other polarity.

Lastly, Canadian Pat. No. 914,610 discloses an electrolysis cell of the initially described kind, through which the electrolyte flows from the bottom to the top in a horizontally meandering manner. A plurality of such cells can be combined by bolting them back to back to form an installation through whose individual cell chambers the electrolyte flows serially, parallel to the direction of flow, or parallelly, perpendicularly to the direction of flow.

For the input of power, the known cells have on the outside of the cell casing or on the outside of the electrode support plates, if the latter simultaneously form a wall of the cell casing, connecting surfaces or connecting lugs for each polarity, which are bolted or otherwise fastened to the power conductor of copper or aluminum.

In the electrolysis cells disclosed by the two patents named above, the support plate for the individual cathode plates forms a part of the trough-like cell casing or it is welded or bolted to the cell casing. In general, the cell casing, consisting of iron or titanium, is connected in an electrically conductive manner to the cathode, i.e., it is cathodically connected, while the anode is fastened so as to be electrically insulated from the cell casing and leakproof.

In the known electrolysis cells of monopolar design, the total current is carried directly to the support plate, which in some cases simultaneously forms the cell wall, and from thence it is uniformly distributed to the individual electrode plates fastened perpendicularly on the support plate. In a cell constructed, for example, for a power input of 6 kiloamperes (kA), which contains a support plate having eleven individual cathode plates fastened thereon and electrically at the same potential as the casing, as well as a titanium support plate with twelve individual anode plates fastened thereon and extending into the twelve cathode interstices formed by the eleven individual cathodes, thus forming electrolyte interstices each 4 mm wide, the total current is conducted through copper bus bars to the cathode support plate. 0.5 kA is fed to each individual electrode and a current of 6 kA flows from the anode support plate through copper bus bars to the next cell. Since the vertical length of the individual anode plates must not exceed 600 to 700 mm, since otherwise considerable losses of yield and power would result, the current input and the output of a cell cannot be increased simply by extending them in the vertical direction if the cell is to operate economically. On the other hand, on account of the relatively poor conductivity of the titanium usually used for the anodes, the horizontal length of the individual anode plates depends on their thickness; thus, for an individual anode 500 mm high and 200 mm wide, a metal thickness of 1 to 2 mm is required.

Thus, if it were desired, in the case of one of the known cells to double the power input by doubling the horizontal dimension, the metal thickness would have to be quadrupled, i.e., the metal thickness of the individual anode plate would have to be increased with the square of the current input. For practical and economic reasons, therefore, the known cells having opposite, electrode-bearing sidewalls are suitable for no more than a limited power input of, say, 10 kA.

SUMMARY OF THE INVENTION

The invention is addressed to the object of avoiding this disadvantage and creating an electrolysis cell of the initially described kind, which permits a power input that is one order of magnitude higher, but is nevertheless of very simple and compact construction and is simple in its operation. Another object is to create an electrolysis cell in which the electrodes can be precisely mounted and easily replaced, and in which short times of stay of the electrolyte within the cell are possible.

This object is achieved in accordance with the invention by the fact that the electrode or electrodes of one polarity ("middle electrodes") are disposed each between two electrodes of the other polarity.

In this manner it is brought about that, for the first time, cells can be made for a current input of 100 kA and more, without the need for the individual anode plates to be larger in all three dimensions than is needed for a current input of, say, 0.5 kA, i.e., without the occurrence of yield losses and energy losses as compared with the yield balance and energy balance hitherto obtainable with the known cells, whose current input had been limited to a maximum of 10 kA. Therefore, without the need of any modification of the recognized optimum size of the individual anode plate, it is possible in accordance with the invention to create extremely compact and therefore easily installable and replaceable electrode packs whose current input can amount to 25 kA and more, and which can be assembled in accordance with the modular principle to form cells with a current input of 100 kA and more. These electrode packs which have for the first time been made possible by the invention additionally make it possible to deliver the total current not just to the outer wall of the cell bearing the individual electrode plates in some form, but directly to the interior of the cell and from there to both of the oppositely situated counter-electrodes.

The electrolysis cell of the invention is especially suitable for electrolysis installations for the production of alkali chloride solutions, of alkali persulfates from acid alkali sulfate solutions, and of alkali superphosphates from alkali phosphate solutions.

BRIEF DESCRIPTION OF THE DRAWINGS

Additional details of the invention as well as additional advantages achieved thereby will be explained hereinafter in conjunction with the drawing and the subordinate claims.

In the drawings

FIG. 5 is a cross sectional view taken through an electrode pack fastened to the cell wall, FIG. 6 is a cross sectional view taken through a threaded ring used in fastening the individual electrode plate of FIG. 5, FIG. 7 is a cross sectional view taken through a second embodiment of an electrode pack fastened to the cell wall.

DESCRIPTION OF THE INVENTION

Figure 1:
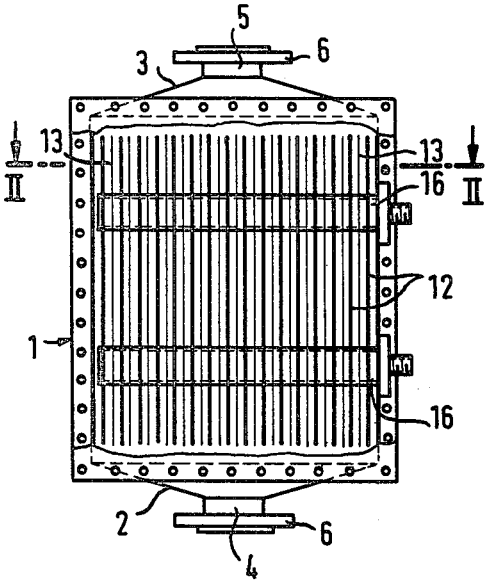
FIG. 1 is a side elevational view partially cut away to show a cross section taken along line I—I of FIG. 3.
Figure 3:
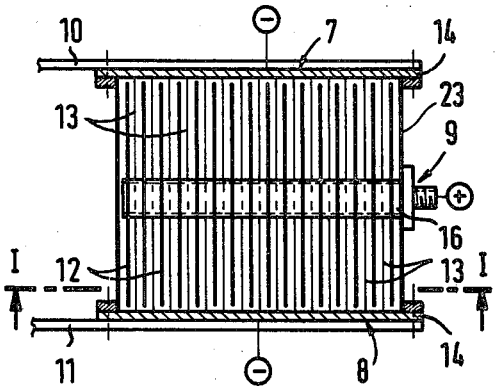
FIG. 3 is a cross sectional view taken along line II—II of FIG. 1.
Figure 2:
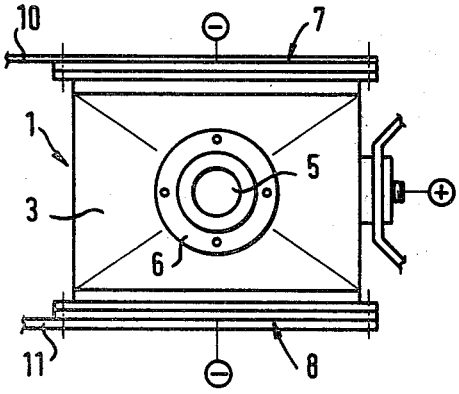
FIG. 2 is a top plan view of the electrolysis cell of FIG. 1.

The electrolysis cell (FIG. 1) consists of a cell casing 1 of titanium having a truncatopyramidal bottom 2 and a truncatopyramidal cover 3. The bottom 2 terminates in an inlet connection 4 and the cover 3 terminates at the top in an outlet connection 5 for the electrolyte which flows vertically through the cell from bottom to top. At the inlet connection 4 and at the outlet connection 5 are flanges 6 for the fastening of pipes for feeding the electrolyte and for carrying away the electrolysis products. Within the cell casing 1 are disposed three electrodes 7, 8 and 9, two of which pertain to the same polarity. The two outer electrodes 7 and 8 (FIGS. 2 and 3) are connected by means of copper conductors 10 and 11 to the negative pole of a voltage source and thus are connected as cathodes, while the center electrode 9 disposed between the two cathodes 7 and 8 is connected by copper conductors (not shown) to the positive pole of the voltage source and thus it is connected as an anode.

The middle electrode 9 is a compact anode packet composed of a plurality of individual anode plates 12. The cathodes 7 and 8 also are built up of a plurality of individual cathode plates 13. The cathode plates 13 are fastened equidistantly and parallel to one another in an upright position between two support plates 14. The support plates 14 simultaneously constitute the sidewalls of the cell casing 1. They are joined to the other parts of the cell casing 1 in a leakproof but electrically insulated manner, for example with the aid of PTFE-jacketed screws. The power lines 10 and 11 are fastened to the outsides of the support plates 14. All other parts of the cell casing 1 are electrically connected with the anode 9.

Figure 4:
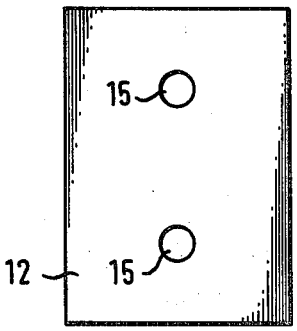
FIG. 4 is a top plan view of one electrode plate.

The individual anode plates 12 are rectangular and have two circular holes 15 symmetrically arranged on their central axis (FIG. 4). The anode plates 12 are fastened to two sleeves 16 passing through the holes 15 so as to be equidistant, parallel to one another, and perpendicular to the longitudinal axis of the sleeves 16. The cathode plates 13 are rectangular and have at their free longitudinal edge two semicircular cut-outs which are disposed so as to accommodate the sleeves 16 between the two sets of cathode plates 13 fastened to the oppositely placed support plates, leaving a narrow annular gap between said cathode plates and said sleeves 16.

Whereas all of the cathode parts consist of steel, all of the anode parts consist of titanium. The anode plates 12 are coated on one or both sides with a conventional activating substance.

The sleeves 16 (FIG. 5) have an external screw thread 17 and an internal thread 18 into which an end piece 19 is screwed and welded in place. At the open end, the sleeve 16 has an annular flange 20 which, after the interposition of a gasket 21, is tightly pressed against the inner side 22 of the wall 23 of casing 1. The fastening of the sleeve 16 to the wall 23 of casing 1 is accomplished by means of screws 25 which engage in taps 26 in the annular flange 20. A threaded copper rod 27 is screwed into the internal thread 18 of the sleeve 16, and by means of two copper nuts 29 a current conductor 28 connected to the positive pole of a voltage source is fastened to its free end. The threaded sleeves 16 thus serve not only as supports but also as current conductors feeding power to the anode pack.

The sleeve 16 can, in accordance with other embodiments of the invention which are not represented in the drawing, be provided also at its open end with an annular flange which is not threaded for mounting screws; in this case the fastening of the sleeve to the external wall of the cell casing can be effected directly by means of a threaded copper rod screwed into the internal thread of the sleeve and a lock nut screwed onto the outside of the cell. The sleeve 16 can also be made of solid copper and coated with titanium by flame spraying, the threaded rod provided for fastening to the outside wall of the cell casing being threaded into a threaded hole bored into the copper core of the sleeve, which need only extend through a short portion of the length of the sleeve.

For the assembly of the anode pack 9, first the sleeves 16 are fastened on an assembly plate (not shown in the drawing) such that the annular flange 20 rests on the assembly plate. Then an anode plate 12 coated on one side only is placed over the upright sleeves and pushed downwardly so that the sleeves pass through the holes 15, unitl the uncoated side engages the face of the annular flange 20. The anode plate 12, which is thus only loosely placed on the sleeves, is then screwed tightly to each sleeve 16 by means of a threaded ring 30. Then an anode plate 12 that is coated on both sides is placed over the sleeves 16 and affixed with another threaded ring 30. This is repeated until the desired number of anode plates is tightly attached to the sleeves 16. The last anode plate 12 is again one that is coated on only one side, but this time it is placed with the coating downward, and fastened with a threaded ring 30.

Since the individual anode plates 12 are preferably designed for a current input of 0.4 to 0.5 kA per coated side, two outer anode plates coated on one side and nineteen inner anode plates coated on both sides are required, for example, for a twently kA cell. The threaded titanium sleeves can similarly accommodate up to, say, thirty anode plates.

In accordance with a preferred embodiment of the invention, the threaded rings 30 have a slot 31, a tap 32 disposed perpendicularly to said slot and a tightening set screw 33 (FIG. 6) whereby it can be clamped onto the external thread 17 of the sleeves 16.

This brings it about that the contact resistances to the passage of the current from the current carrying sleeves to the individual electrode plates can be kept to a minimum. Furthermore, by the selection of the appropriate thickness of the threaded rings, any desired spacing between the individual electrode plates can be established precisely.

According to another preferred embodiment of the invention, all of the surfaces on sleeves 16, anode plates 12 and threaded rings 30 which serve for contact pressure and the transfer of current are provided with a platinum coating for good conductivity. For this purpose, all of these surfaces must be planar.

While the above-described method of fastening the anode plates 12 to the sleeves 16 is used primarily for cells of medium current input of, for example, 20 kA, a different method of fastening is used preferentially in accordance with another embodiment of the invention for cells of higher current input (FIG. 7). The sleeve 35 of titanium has, like sleeve 16, an internal thread 36, an end plug 37 threaded and welded in place, and an annular flange 38. On its external cylindrical periphery, however, the sleeve 35 has, instead of a thread, equidistant annular superelevations 39 of the same thickness as the anode plates and of a diameter that is only one to two millimeters smaller than the diameter of the holes 15 in the anode plates 12. In the assembly, two such sleeves 35 are again fastened with the annular flange 38 downward on an assembly plate. Then an anode plate 12, which is coated on one side, is placed downwardly over the two sleeves 35 with the active coating up and is fastened to the annular flange 38 by means of recessed-head screws 40. The following anode plates 12 which are coated on both sides are brought into the assembly position by means of jigs and attached spot-wise to the annular superelevations 39 by any suitable welding method (e.g., argon arc impulse welding).

The welding method must utilize a sufficiently great concentration of energy to enable the welding to be performed very rapidly. The weld zone must not be broader than one millimeter to prevent distortion of the electrode plates.

Figure 8:
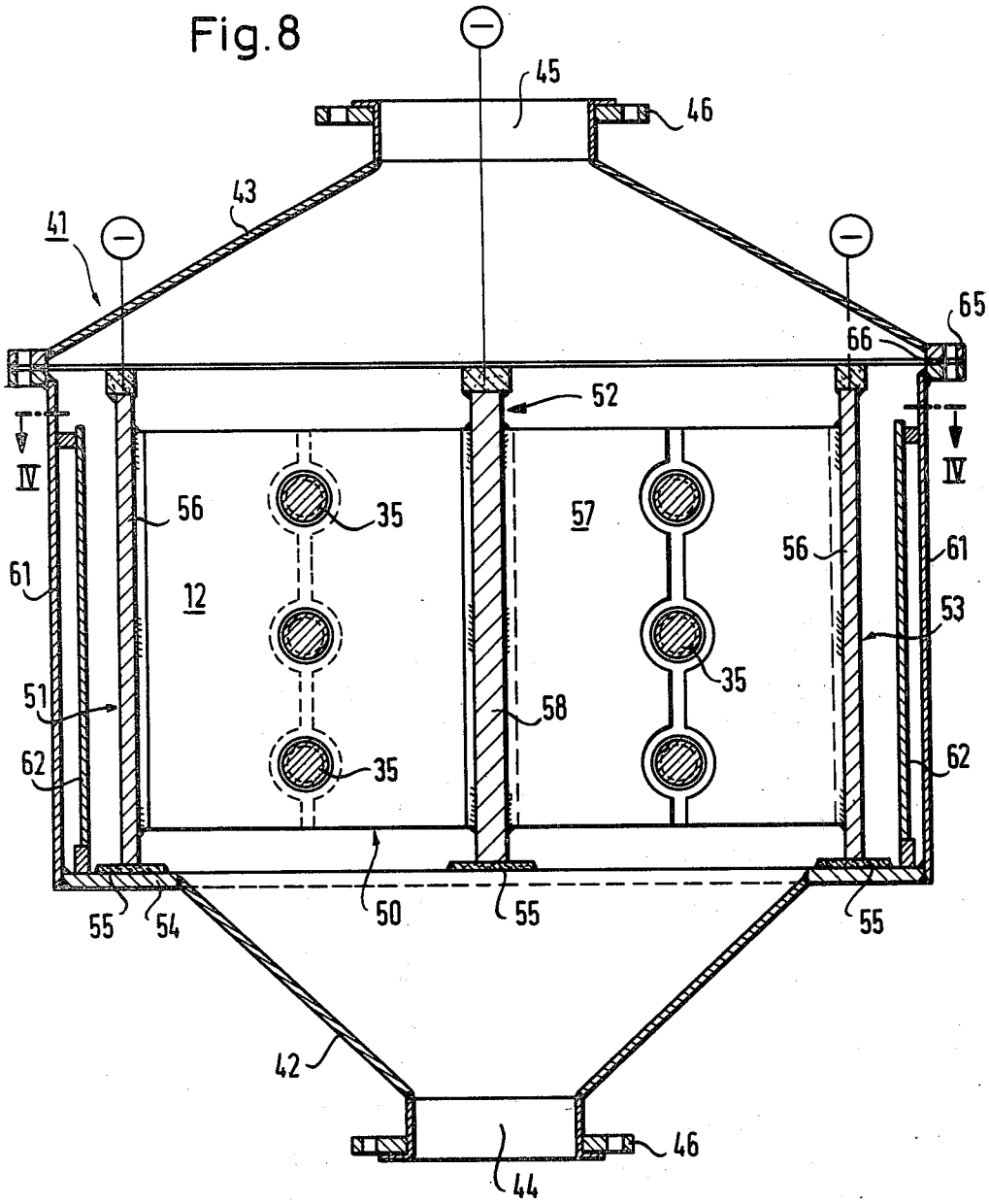
FIG. 8 is a second embodiment of the electrolysis cell of the invention shown in a cross section taken through line III—III of FIG. 9.
Figure 9:
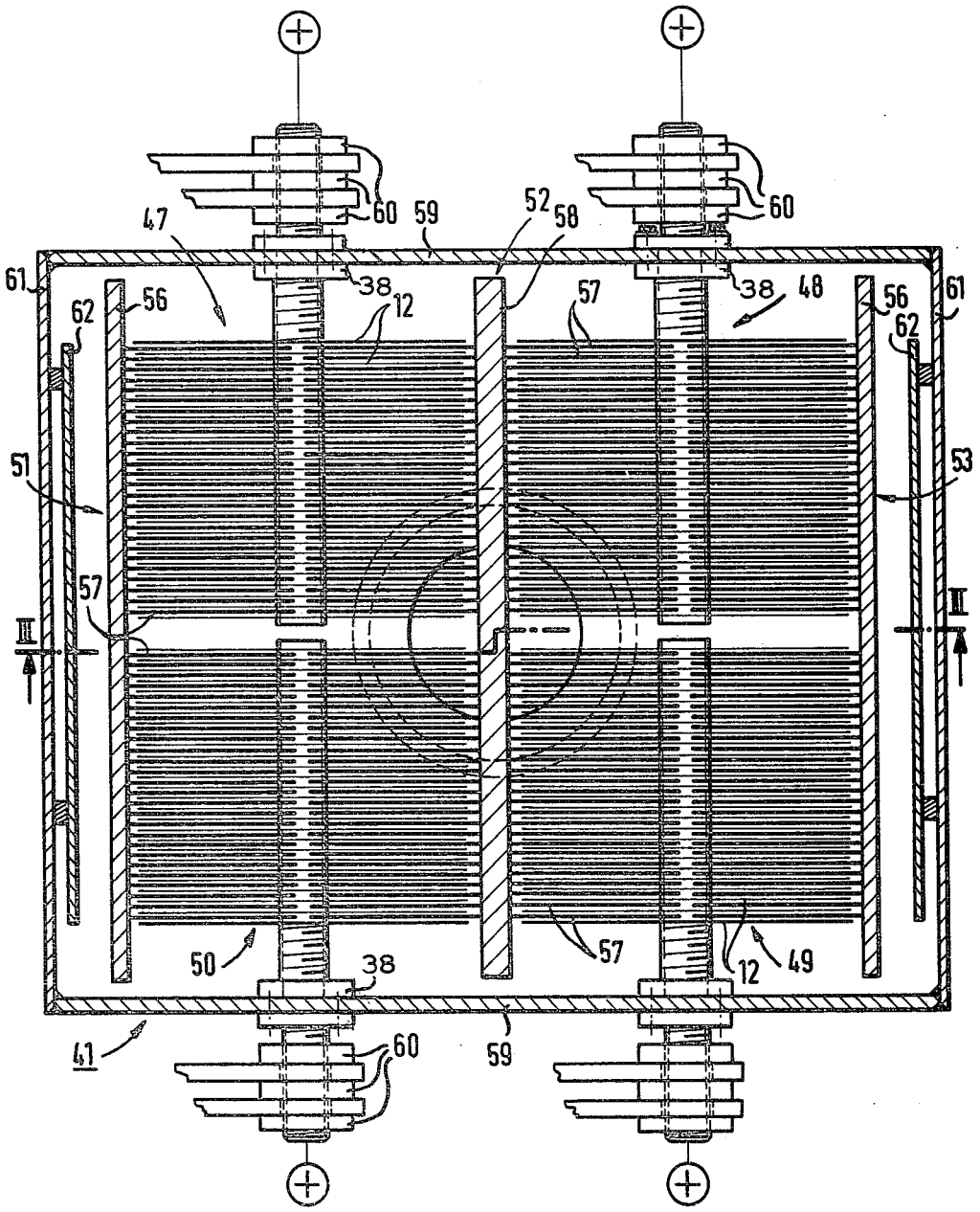
FIG. 9 is a cross sectional view taken along line IV—IV in FIG. 8.

For cells of a current input of up to about twenty kiloamperes, regardless of the manner in which the anode plates are fastened to the current carrying sleeves, only one anode pack is required, which is fastened on preferably two current carrying sleeves. In cells of high current input, of, for example, 100 kA or more, a plurality of such anode packs each with more than two current carrying sleeves are required. For example, another preferred embodiment of the electrolysis cell of the invention, which is designed for a current input of about 100 kA, contains four anode packs for a current input of about 25 kA each (FIGS. 8 and 9). In this cell, four anode packs 47 to 50, which are disposed as center electrodes each between two of the total of three cathodes 51 to 33, are situated in the trough-like cell casing 41 with the downwardly tapering truncatoconical bottom 42 and the upwardly tapering truncatoconical top 43, equipped with inlet and outlet connections 44 and 45, respectively, for the electrolyte which flows through the cell vertically upwardly, and with the connection flanges 46 for the electrolyte infeed and outfeed lines. The cathodes 51 to 53 are anchored to a supporting grid 54, but are electrically insulated therefrom and consequently from the cell casing 41 by insulators 55.

Each of the anode packs 47 to 50 is composed of three sleeves 35 on which there are welded, by the method described above, twenty-seven individual anode plates 12, twenty-five of them coated on both sides and two on one side. The two outside cathodes 51 and 53 consist each of a steel support plate 56 having iron plates 57 welded on it perpendicularly to each side. The middle cathode 52 consists of a steel support plate 58 with iron plates 57 welded perpendicularly on both sides thereof.

In the assembly of this cell, first the middle cathode 52 is fastened to the supporting grid 54 with the insulator 55 interposed. Then the four anode packs 47 to 50 are fastened on the side walls 59 of the cell casing 41 with the interposition of O-rings (not shown), annular flange 38 in the cell and copper nuts 60 outside of the cell for holding the conductors on, preferably such that, when necessary for repair and maintenance purposes, after the removal of the cover 43, they can be lifted up out of the cell casing. Lastly, the two outside cathodes 51 and 53 are pushed inwardly horizontally and fastened to the supporting grid 54 with the interposition of insulators 55. For the protection of the rear sides of the outer cathodes 51 and 53, anodes 62 are disposed vertically between the steel support plates 56 and the side walls 61 of the cell casing 41 and connected in an electrically conductive manner to the said casing 41. Finally, the cover 43 of the cell casing 41 is superimposed and bolted in a leak-proof manner to the flange 65. The interposed gasket 66 does not have to be electrically insulated, since the cover 43 and the bottom 42 of the casing 41 are connected anodically.

On the basis of the above-described, preferred embodiment of a 100 kA electrolysis cell it is especially easy to perceive the advantages achieved by the invention. The principle on which the invention is based, according to which the electrode or electrodes of one polarity are disposed each between two electrodes of the other polarity within an electrolysis cell, makes it possible for the first time to build electrolysis cells having a current input capacity as high as 100 kA or more which, despite this high current input, will operate under conditions equivalent to those of the formerly known monopolar cells with a current input capacity of around 10 kA. The term, "conditions," in this case, is to be understood to refer primarily to: current losses, current yield, uniform distribution of the current density over the entire cell cross section, time of stay of the electrolyte within the cell, flow conditions, and the like.

Regardless of its size and the current input for which it is designed, the electrolysis cell of the invention has the additional advantage that it is of much more compact construction than the known monopolar cells for the same output, that it is more resistant to corrosion, that the reaction products can be carried away rapidly from the electrolysis chamber, and that the electrodes can be installed precisely and can be replaced and maintained with especial ease. These advantages bring it about, furthermore, that the cell of the invention is especially simple and comparatively inexpensive to manufacture, and they assure that the operation of the cell of the invention will be especially economical.

Additional advantages consist in the fact that the electrical connections for a plurality of cells of the invention in series are easy to arrange, with a short distance between cells, and that the electrolysis cells of the invention can be easily incorporated into any desired electrolyte distributing system, for example in such a manner that the electrolyte flows from a common reservoir into the individual cells, passes through them in parallel, and then runs again into a common reservoir which can be designed to serve simultaneously as a gas separator.

The especially advantageous pack method of arranging the middle electrodes, which in the above description is always explained in terms of anodically connected electrodes, can quite similarly be used also when the polarities are reversed. In other words, cathode packs analogous to the anode packs can be constructed of the above-described sleeves and individual electrode plates.

In a preferred embodiment of the invention, the cell casing is in electrical contact with the anode pack or with the power supply to the anode. In this manner the cell casing is anodically protected against any kind of corrosion. This is a considerable advantage over the known monopolar cells in which the casing is usually at the same potential as the cathodes. In the latter case, if the casing is made of steel or ferrous alloy, its surfaces which are not exposed to the direct flow of current—at the inlet and outlet connections for example—must be cathodically protected by auxiliary anodes; if, however, the casing consists of titanium, the cathodic formation of hydrogen produces a titanium hydride coating. The consequence of this is that, due to the expansion of the titanium lattice by the absorption of hydrogen, brittle coatings form on the surface which spall from the metal substrate under operating conditions, particularly in the case of fluctuating temperatures. The titanium casing becomes brittle and, in the most unfavorable case, becomes perforated by cracking at the corners and edges; titanium hydride particles which flake off can even produce short circuits in the narrow gaps between the electrodes.

The characteristics of a number of embodiments of the electrolysis cell of the invention are described in the following examples:

EXAMPLE 1

A cell with a 20 kA current input for chlorate electrolysis is constructed in accordance with the above-described method of assembly using an anode pack made from three threaded sleeves on which the individual anode plates are fastened by means of the threaded clamp rings described. The spacing between the individual plates of the electrode is 3.0 mm. The resistance of the current input is determined experimentally to be 20 to 60 microohms at the anode pack. The power loss at the current input to the anode pack thus amounts to 60 to 180 watts, corresponding to 0.1 to 0.3% of the cell power, and can be considered to be very low. The voltage amounts, under electrolysis conditions at 80° C., to 3.1 volts at a current density of 3 kiloamperes per square meter of anode surface. The current yield is between 93 and 95%.

EXAMPLE 2

A chlorate electrolysis cell of 25 kA current input is constructed with the use of an anode packet consisting of twenty-five anode plates coated on both sides and two coated on one side and three threaded sleeves. At 3 $kA/m^2$ of current density the cell has a voltage of 3.1 volts.

EXAMPLE 3

To make an electrolysis cell suitable for the preparation of persulfates and superphosphates, an anode pack is assembled from eleven individual anode plates, two of them coated on one side, and three threaded sleeves. The individual anode plates consist of titanium 5 mm thick, and they measure 500 × 400 mm; the inside plates are explosion clad on both sides and the outside plates on one side with a pure platinum sheet 50 micrometers thick. (Anode plates with suitable galvanic coatings of pure platinum can also be used. However, coatings of the kind used for chlorate electrolysis are not suitable, since they are not capable of forming active oxygen compounds.) The anode pack is fastened within a casing of titanium such that the casing is in electrical contact with the positive polarity, whereby it is completely protected against electrolytic corrosion. The cathodes consist of high-grade steel of appropriate composition (cathodes of pure titanium can also be used). The power input to the cell amounts to 20 kA at an anodic current density of 6 $kA/m^2$. The spacing of the individual electrode plates from one another amounts to 5 mm. Under the conditions of the production of potassium persulfate (1.3 moles per liter of $K_2SO_4$, moles per liter of $H_2SO_4$), the voltage amounts to 5.1 volts.

The cell is also suitable for the production of ammonium persulfate and sodium persulfate as well as superphosphates. $K_4P_2O_8$ is obtained, for example, by the electrolysis of an alkaline potassium phosphate solution (approx. 3 moles/l) at 3 $kA/m^2$ and 4.9 volts. On the other hand, the diaphragm-less cells commonly used heretofore for the preparation of persulphates and superphosphates have had a current input of 0.5 to 1.5 kA.

The electrode pack of the electrolysis cell of the invention can accordingly also be provided with diaphragms and used in chlorine-alkali electrolysis.

It will be understood that the specification and examples are illustrative but not limitative of the present invention and that other embodiments within the spirit and scope of the invention will suggest themselves to those skilled in the art.

What is claimed is:

1. An electrolysis cell having a housing with an inlet and an outlet for a through-flowing electrolyte and at least three monopolar electrode packs each comprising plates fastened on a common carrier in parallel array wherein the plates of one polarity extend into the gaps formed between the plates of the other polarity and wherein at least one electrode pack of one polarity is disposed between two electrode packs of the other polarity.

2. The electrolysis cell as claimed in claim 1 wherein said at least one electrode pack comprises a plurality of individual electrode plates having symmetrically disposed circular cut-outs and at least two sleeves received through the cut-outs to tightly join the plates to form a compact unit.

3. The electrolysis cell as claimed in claim 2 wherein the sleeves have an external screw thread and further comprising threaded rings for tightly securing the individual electrode plates on the sleeves.

4. The electrolysis cell as claimed in claim 3 wherein the threaded rings are split and further comprising a tightening screw for tightly pressing their internal thread upon the external thread of the sleeves.

5. The electrolysis cell as claimed in claim 2 wherein the sleeves have annular superelevations projecting vertically from their periphery, to which the individual electrode plates are welded.

6. The electrolysis cell as claimed in claim 2 wherein the sleeves are tightly joined to copper bars as current feeders.

7. The electrolysis cell as claimed in claim 6 wherein the copper bars used as current feeders are screwed to the sleeves.

8. The electrolysis cell as claimed in claim 3 wherein said at least one electrode is anodically connected.

9. The electrolysis cell as claimed in claim 8 wherein the individual electrode plates, the sleeves and the threaded ring comprise corrosion-proof and/or electrochemically passivatable material or are coated with such a material.

10. The electrolysis cell as claimed in claim 9 wherein the electrode plates, the sleeves and the threaded rings comprise titanium or are coated with titanium.

11. The electrolysis cell as claimed in claim 1 wherein said at least one electrode pack is cathodically connected.

12. The electrolysis cell as claimed in claim 11, wherein the cell housing is in electrical connection with anodes.

13. The electrolysis cell as claimed in claim 12 wherein the cell housing comprises passivatable metal.

14. The electrolysis cell as claimed in claim 13 wherein the cell housing comprises titanium.

15. The electrolysis cell as claimed in claim 1 wherein the cell housing comprises a truncatopyramidal cover and a truncatopyramidal bottom.

16. The electrolysis cell as claimed in claim 15 further comprising flanges defining an inlet and an outlet for the electrolyte in the bottom and in the cover of the cell housing respectively.

17. The electrolysis cell as claimed in claim 1 wherein the electrode packs are disposed in the cell housing such that the electrode plates stand vertically and the electrolyte flows vertically upwardly and uniformly over the entire cell cross section through the interstices formed by the electrode plates.

18. The use of the electrolysis cell as claimed in claim 1 for electrolysis installations formed of a plurality of series-connected cells through which the electrolyte flows in parallel, for the production of alkali chlorates, alkali persulfates and alkali superphosphates.

* * * * *